US005421157A

United States Patent [19]

Rosenblatt

[11] Patent Number: 5,421,157

[45] Date of Patent: Jun. 6, 1995

[54] ELEVATED TEMPERATURE RECUPERATOR

[76] Inventor: Joel H. Rosenblatt, P.O. Box 198, Summerland Key, Fla. 33042

[21] Appl. No.: 59,662

[22] Filed: May 12, 1993

[51] Int. Cl.[6] ..... F01K 25/06

[52] U.S. Cl. ..... 60/649; 60/651; 60/655; 60/673

[58] Field of Search ..... 60/655, 649, 673, 671, 60/651, 676, 678

[56] References Cited

U.S. PATENT DOCUMENTS

| | | | |
|---|---|---|---|
| 4,009,575 | 3/1977 | Hartman, Jr. et al. | 60/651 |
| 4,130,992 | 12/1978 | Bitterlich et al. | 60/678 |
| 4,330,998 | 5/1982 | Nozawa | 60/655 |
| 4,444,015 | 4/1984 | Matsumoto et al. | 60/651 |
| 4,573,321 | 3/1986 | Knaebel | 60/655 |

*Primary Examiner*—Ira S. Lazarus
*Assistant Examiner*—L. Heyman
*Attorney, Agent, or Firm*—Jacobson, Price, Holman & Stern

[57] ABSTRACT

A low temperature engine system has an elevated temperature recuperator in the form of a heat exchanger (12) having a first inlet connected to an extraction point (45) at an intermediate position between the high temperature inlet and low temperature outlet (14) of a turbine heat engine (8, 10) and an outlet connected by a conduit (47) to a second inlet to the turbine between the high and low temperature ends thereof and downstream of the extraction point (45). In the recuperator (12) thermodynamic medium vapor from extraction point (45) is in heat exchange relationship with thermodynamic medium conducted from the low temperature exhaust end (14) of the turbine unit (8, 10) through a water cooled condenser (6) and in heat exchange relationship in a refrigerant condenser (2) with a refrigerant flowing in an absorption-refrigeration subsystem. The thermodynamic medium leaving the recuperator (12) for return to the turbine is conducted through return conduit (46) in further heat exchange relationship with the refrigerant of the absorbent-refrigerant subsystem (48) and is heated in a heat exchanger (56) by an external source of heat energy and is returned to the high temperature end of the turbine through conduit (58) to complete the cycle. External coolant, such as water, is conducted through the thermodynamic-medium condenser (6) in heat exchange relation with the thermodynamic medium passing therethrough from the low temperature exhaust end (14) of the turbine.

26 Claims, 2 Drawing Sheets

FEED WATER HEATER
STREAM SPLITTER
BOILER VESSEL
ELEV. TEMP RECUPERATOR
RECT.
NH3 COND.
GENERATOR
NH3 PRECOOLER
HYD. COND.
UHT
LHT
ALTERNATOR
EVAP.
ABS
PRECOOLER
HEAT EXCH.

ELEVATED TEMPERATURE RECUPERATOR

BACKGROUND OF THE INVENTION

This invention relates to an improvement to my Low-Temperature Engine system (LTES) described in U.S. Pat. No. 4,503,682, which is incorporated herein by reference, and other turbine systems employing organic Rankine cycles (ORC).

The use of hydrocarbon media in organic Rankine power turbine cycles has been a developing art for some time. Many of these media possess the property of a characteristic saturation curve with a reverse slope to that of their isentropic curves across the range of pressures and temperatures traversed during operation of the turbine cycle between an elevated temperature and pressure condition at the turbine entry to the intended turbine exhaust pressure. When such media have acquired some level of superheat during that isentropic expansion process, the superheat level becomes an additional amount of waste heat that must be rejected during the condensation process before liquefying of the vapor at the saturation temperature for that exhaust pressure can begin. Normal butane, isobutane, and isopentane are among the more common hydrocarbon turbine media exhibiting this characteristic as well as several of the fluorinated hydrocarbons that have been employed as turbine media.

Numerous efforts to minimize this source of waste heat loss have been reported in the literature. Among them have been:

a. Efforts to introduce the medium at the turbine entry in a "wet vapor" condition in an effort to permit the vapor to dry during its expansion cycle through the turbine to arrive at the turbine exit in a saturated or less superheated condition. This approach has unfortunately encumbered a problem due to piping effects between the hydrocarbon boiler and the turbine resulting in separation of some of the moisture content into "slugs" of liquid which, upon entering the turbine, cause damage or erosion to the turbine blading.

b. The use of a supercritical entry condition under which the medium, at a supercritical temperature and pressure, enters the turbine and expands through regions in which it passes through wet vapor conditions to reemerge dryer as expansion continues, ultimately arriving at the turbine exit pressure at, or very nearly at, its saturation temperature for that pressure. This method unfortunately is limited to applications in which the peak temperature available in the boiler is sufficient to produce a temperature in the supercritical region, and often requires the expenditure of excessive parasitic plant power to pump the turbine medium up to whatever pressure may be required to reach the supercritical pressure necessary for the turbine medium employed.

c. The use of a "recuperator" has frequently been introduced. This item consists of a heat exchanger placed between the turbine exhaust vapor and the returning turbine medium condensate from the condenser. This permits most of the superheat to be regeneratively recovered by the returning liquid turbine medium feed stream. The unrecoverable superheat is reduced to that involved to maintain the minimum approach difference in temperature across the recuperator heat exchanger.

The LTES cycle achieves the output power increase it offers by virtue of an extended turbine cycle operating between the temperature of the ambient temperature condenser of a conventional turbine cycle and a sub-ambient condenser made available by artificial refrigeration. In order to accomplish this without expending more external heat energy to operate the refrigeration sub-system than that which could have produced more output power by being supplied to a conventional turbine cycle, an absorption refrigeration subsystem (AR system) is employed whose above ambient waste heat rejection is recovered regeneratively by turbine medium feed stream heating.

However, the contribution toward producing an output power increase offered by the LTES is directly proportional to the ratio of the mass flow in the above ambient portion of the turbine cycle to that able to be condensed by the refrigeration capacity of the AR subsystem. That contribution to the total system output is diluted by the extent to which enough of the above-ambient turbine medium mass flow must be supplied which has the capacity to absorb the latent heat rejected from the AR subsystem to condense the refrigerant circulating therethrough. The temperature gradient across which this heat rejection must occur is limited to the temperature differential between the ambient turbine condenser and the saturation temperature of the AR subsystem refrigerant at its condenser pressure.

Because of that situation, raising the temperature of the ambient turbine condensate above its condensation temperature by use of a conventional recuperator reduces the remaining thermal gradient available to absorb additional heat rejected from the AR subsystem condenser, with a consequent increase of the total above-ambient mass flow in the turbine cycle being needed to provide the remaining heat absorption capacity. Such a situation further dilutes or negates the advantage of the LTES concept.

BRIEF SUMMARY OF THE INVENTION

One object of the present invention is to provide a means of obtaining the intended advantages of the recuperator concept without losing the advantage of the availability of the liquid turbine medium condensate at its lowest temperature leaving the ambient turbine condenser needed to maximize its ability to absorb regenerative heat transferred from the AR subsystem refrigerant condenser.

Another object of this invention is to provide an LTES system having a means of recovering superheat from the expanding turbine medium in a form permitting that heat transfer to be accomplished without encumbering the minimum heat loss involved in the need to maintain a minimum temperature approach difference between the superheat recovered and the temperature of the turbine condensate characteristic of the conventional recuperator concept described.

Another object of this invention is to provide an LTES system having the ability to permit a wet vapor condition to be introduced above the turbine exhaust pressure without exposure to the risk of liquid "slug" damage that accompanies such a condition when it occurs before the turbine entry point, permitting continued expansion to the ambient turbine exit pressure with little or no residual superheat contribution to the total waste heat rejected to the ambient cooling sink.

This invention accomplishes the above objectives by providing a low temperature engine system to which heat energy input is supplied, an absorption-refrigeration subsystem, an absorbent refrigerant liquor circulating through the subsystem for synthesizing and imparting to a turbine condenser a continuous-flow low temperature heat sink at a selected temperature, a low temperature heat engine, a thermodynamic medium circulated in heat exchange relationship with the heat engine and the heat energy input supply and in heat exchange relationship at the refrigerant condenser with the refrigerant vapor. The thermodynamic medium has a vaporization temperature lower than that of steam at the same pressure and a melting point temperature lower than that of water. The low temperature heat engine operates across a thermal gradient having a high temperature end in heat exchange relationship with the thermodynamic medium from the heat energy input means and a low temperature end through which the thermodynamic medium flows before heat exchange relationship with the synthesized continuous-flow low temperature heat sink of the absorption-refrigeration subsystem. An external cooling source provides a cooling fluid in heat exchange relationship with the refrigerant liquor external of the refrigerant liquor absorber. An elevated temperature recuperator in the form of a heat exchanger has an inlet communicating with an extraction point between the high and low temperature ends of the lower temperature engine at a position upstream of ambient exhaust pressure for extraction of thermodynamic medium vapor. The thermodynamic medium flows through a thermodynamic medium condenser in heat exchange relationship with an external coolant flowing therethrough and the condensate then flows through a refrigerant condenser in heat exchange relationship with refrigerant vapor counterflowing therethrough and circulating through the absorption refrigeration subsystem. The warmed thermodynamic medium from the refrigerant condenser then passes through the recuperator in heat exchange relationship with the thermodynamic medium from the extraction point of the low temperature engine where it is heated by absorption of the superheat content from the extracted turbine medium vapor and is conducted through a further heat exchange unit in heat exchange relationship with an external heat supply source for heating to turbine entry conditions at the high temperature end of the turbine. The thermodynamic medium from the extraction point flowing through the recuperator then flows to an intermediate entry point in the turbine between the inlet end and ambient exhaust end and downstream of the extraction point and then flows through the remainder of the turbine and is exhausted at the downstream ambient exhaust end from which it returns to the turbine cycle condenser thus completing the cycle.

BRIEF DESCRIPTION OF THE DRAWING

The invention will now be described in detail with reference to the accompanying drawing wherein.

DETAILED DESCRIPTION

Figure 1:
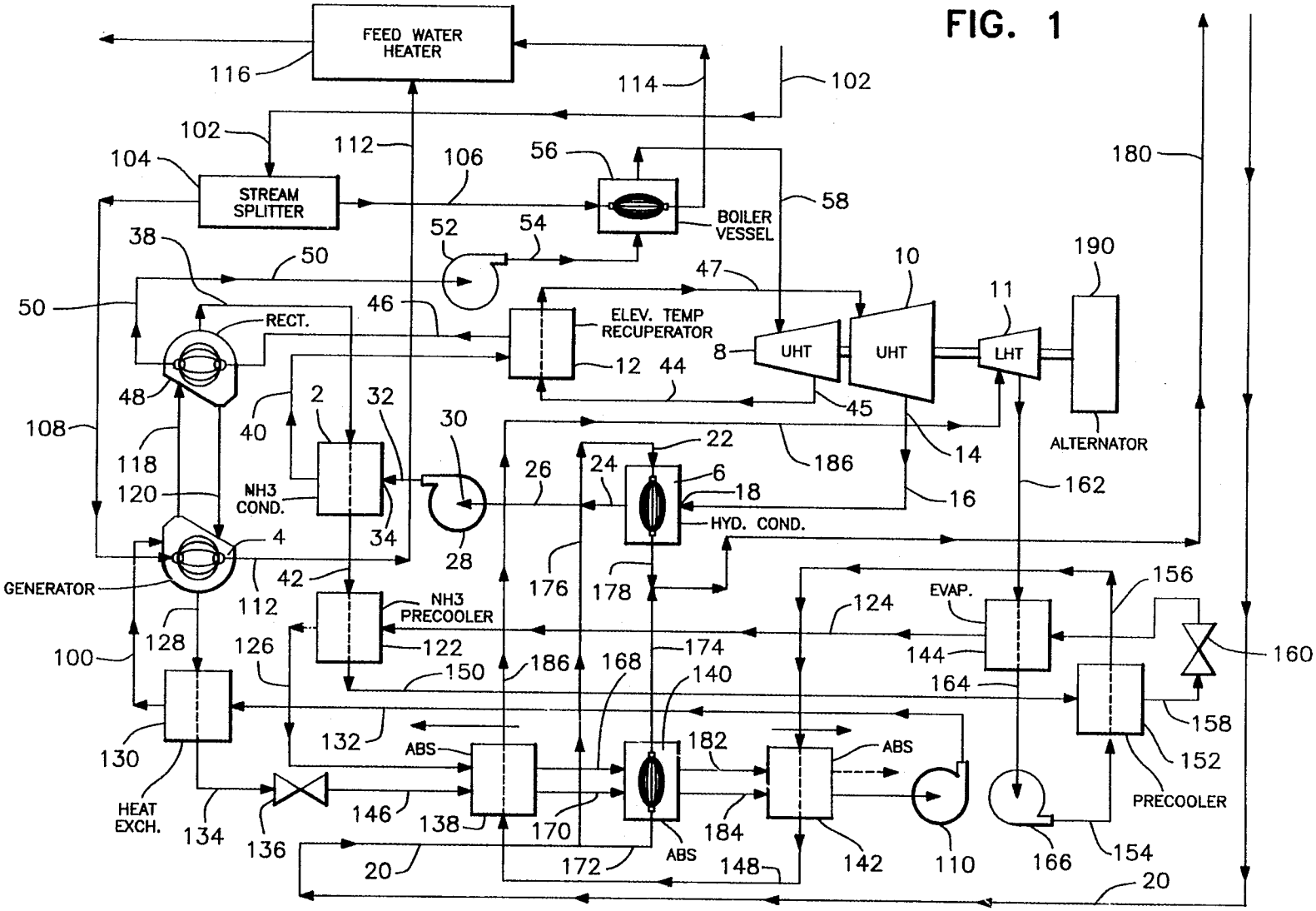
FIG. 1 is a system diagram of an embodiment of a low temperature engine system incorporating the present invention.

Some components in FIG. 1 are components of the absorption refrigeration (AR) sub-system as described in the referenced U.S. Pat. No. 4,503,682, and perform the same refrigeration sub-system functions as in the patent.

Within that AR sub-system, a concentrated solution of refrigerant (e.g., ammonia) in its absorbent (e.g., water) enters the generator 4 via conduit 100. It is heated therein by a stream of steam from an external source such as exhaust from a high pressure steam turbine (not shown) associated with the system. That steam enters the system via conduit 102 and through a stream splitter 104, a portion being split off to supply external heat to a conventional hydrocarbon turbine cycle boiler vessel 56 via conduit 106, while the remainder becomes the external heat source supplying steam via conduit 108 to generator 4, under conditions that raise the temperature at the elevated pressure in generator 4 created by circulating pump 110. The steam condensate return from generator 4 via conduit 112 and from boiler 56 via conduit 114, is returned to the steam condensate return of the system that delivered the external heat via unit 116, which could be a feed water heater stage in the feed water return system of an associated high pressure steam turbine whose exhaust supplied the external heat source via conduit 102 to the entire low temperature engine system.

A high temperature vapor at elevated pressure flows from generator 4 via conduit 118 to rectifier vessel 48. While the operating temperature of generator 4 has been selected to result in maximum vaporization of the ammonia portion of the strong solution entering it, a minor fraction of partial pressure of water accompanies the vapor stream delivered. As that vapor is partially cooled in rectifier vessel 48, that partial pressure water vapor fraction condenses before the ammonia vapor fraction. The liquid condensate thereby formed is trapped out and returned to generator 4 via conduit 120. The ammonia vapor fraction, still at elevated temperature and pressure leaves vessel 48 via conduit 38 to enter the ammonia condenser vessel 2 where it is condensed by flow in heat exchange relationship with condensed counterflowing liquid phase UHT turbine medium entering at 34 via conduit 32, and exiting via conduit 40 after having absorbed both the superheat and latent heat rejected from the ammonia vapor during its condensation in vessel 2. The condensed liquid phase ammonia then flows via conduit 42 to an ammonia pre-cooler 122 wherein it passes in heat exchange relationship with counterflowing ammonia vapor entering via conduit 124 and leaving, slightly warmer, via conduit 126.

The weakened refrigerant/absorbent solution remaining in generator 4 after the vapor was boiled off returns via stream 128, still at elevated temperature and pressure, through a heat exchanger 130 placed between the flows of high temperature weak solution from generator 4 and cooler low-temperature strong solution entering via stream 132. This permits strong solution being directed to generator 4 to be preheated prior to entry therein, while weak solution from generator 4 is pre-cooled prior to entry via conduit 134 into pressure-reducing valve 136, where that weak solution is dropped to the operating pressure of the absorber 138, 140, 142, the same reduced pressure at which the refrigeration sub-system evaporator 144 is operating. Strong cool weak solution then leaves valve 136 at reduced pressure via conduit 146 to combine with ammonia vapor from pre-cooler 122 via conduit 126 in the warm end of absorber, both streams now being at the same reduced pressure. As the two streams mix, both a heat of solution (heat of mixing) and latent heat from condensing ammonia vapor are rejected in heat exchange relationship with a stream of condensed LHT turbine 11 medium supplied to absorber 138 via conduit 148. In that heat exchange process, a portion of the ammonia vapor enters into solution in the weak solution with which it is being mixed, and is partially cooled, while the counterflowing LHT turbine medium is heated to the vapor phase turbine entry state conditions at the entry to the LHT turbine 11.

Liquid phase ammonia refrigerant, still at elevated pressure, which was condensed in condenser 2 and pre-cooled in unit 122, proceeds from unit 122 via conduit 150 to a second ammonia pre-cooler 152. There it is further pre-cooled by being placed in heat exchange relationship with counterflowing cold LHT turbine medium entering via conduit 154 and leaving via conduit 156. Having been further pre-cooled by this process, the high pressure liquid ammonia leaves pre-cooler 152 via conduit 158 to enter pressure reducing valve 160 where its pressure is dropped to the low pressure at which the evaporator and absorber units are operating. That sudden drop in pressure, below saturation pressure for the refrigeration temperature intended to be created in evaporator 144, causes the refrigerant to flash to a vapor phase, absorbing its latent heat of vaporization from the counterflowing vapor phase LHT turbine 11 medium in heat exchange relationship with the refrigerant flowing through evaporator 144.

The LHT turbine 11 medium entering evaporator 144 via conduit 162 in its vapor phase is condensed therein to its liquid phase by that refrigerating effect, and leaves in its liquid phase via conduit 164. The cold liquid turbine medium is then pressurized to its intended turbine entry operating pressure by pump 166 from whence it leaves via conduit 154 to enter pre-cooler 152 as described above. The two phase mixture of ammonia vapor and ammonia/water solution formed in absorber 138 as described above leaves absorber 138 via conduits 168 and 170 and enters absorber stage 140 where the two phases continue being mixed while being further cooled by external ambient cooling water supplied to the system via conduit 20, a portion of which supplies cooling to absorber 140 via conduit 172, by passing in heat exchange relationship within unit 140 and leaving slightly warmer via conduit 174, while the remainder continues as a stream via conduit 176 to become coolant for ambient hydrocarbon condenser vessel 6.

The cooling water leaving absorber 140 via conduit 174 and that leaving condenser 6 via conduit 178 combine to become the cooling water return leaving the system via conduit 180.

As the mixture of ammonia vapor and ammonia/water solution is further cooled in absorber 140, more of the ammonia vapor enters solution rejecting waste heat as it does to counterflowing cooling water. The remaining mixture flows via conduits 182 and 184 to the final stage of the absorber, unit 142. It is finally cooled there to the temperature at which all the remaining ammonia vapor will dissolve in the solution with which it is being mixed to reform the strong ammonia/water solution at its maximum intended solution concentration in the system. That final cooling is accomplished by passing cold LHT turbine medium from unit 152 via conduit 156 in heat exchange relationship with the contents of unit 142 to absorb that last waste heat fraction that must be rejected to effect complete absorption of all ammonia vapor in forming the strong ammonia/water solution. The cold LHT turbine medium leaves unit 142 via conduit 148.

The below ambient turbine system shown in the drawing associated with the sub-ambient turbine 11 is similarly not altered by the present improvement. The LHT turbine 11 driving the alternator 190 to deliver electric power from the system employs a second hydrocarbon medium which circulates from the turbine exhaust leaving turbine 11 via conduit 162 to the AR subsystem evaporator 144 where it is condensed at a sub-ambient temperature by refrigeration developed by the AR subsystem, the cold condensate leaving via conduit 164 to enter pump 166 where it is pressurized to the peak pressure in the LHT turbine cycle, leaving the pump via conduit 154 to become a coolant to pre-cool ammonia refrigerant in pre-cooler 152, leaving unit 152 via conduit 156 to be used again to cool the bottom end of the AR sub-system absorber in unit 142 and finally leaving via conduit 148 having attained its turbine entry vapor phase temperature by absorbing additional waste heat at a higher temperature in AR sub-system absorber 138 from which it leaves via conduit 186 to return to the turbine entry point of the LHT turbine.

While both the refrigeration sub-system described and the operation of the LHT turbine cycle remain as described in the above patent, a significant thermodynamic improvement is effected by combining the need to absorb as much waste heat rejected from the AR subsystem as possible to be retained within the combined cycle system and prevent the loss thereof as waste. A second source of waste heat occurs in the course of operating even a conventional hydrocarbon bottoming cycle such as that which exists in the UHT turbine cycle.

The effort previously described to recover superheat from expanding hydrocarbon media that become superheated as they expand to lower pressures by use of recuperators prior to the ambient temperature hydrocarbon condenser (i.e.—located between pump 28 and the exhaust leaving UHT turbine 10) is counterproductive if it preheats the UHT turbine cycle medium prior to use of that medium to receive heat being rejected from the condenser 2 of the AR subsystem. That heat transfer from condensor 2 must be accomplished using the minimum mass flow of UHT turbine medium to effect ammonia condensation at the saturation temperature for its pressure. That leaves opportunity to absorb heat rejected in the ammonia condenser by the UHT turbine medium operating across the thermal regimen available between its temperature leaving the hydrocarbon condenser 6 and the saturation temperature of the ammonia vapor at its pressure entering the ammonia condenser 2. Were its temperature raised by use of a conventional recuperator stage prior to entry into vessel 2, that temperature gradient available to absorb heat from the condensing ammonia vapor would be reduced, and a greater mass flow of UHT turbine medium would be required to accomplish the purpose across the narrower temperature gradient remaining. However, by selection of the point in the UHT turbine cycle at which superheat present in the expanding UHT turbine medium is higher than the temperature of the UHT turbine medium leaving the ammonia condenser (viz.—an extraction point before the final exhaust end of the UHT turbine, such as a point at the exit of turbine stage 8), recovery of at least the superheat content at that point in the expanding UHT turbine medium cycle can still be accomplished at that higher temperature point in the UHT turbine cycle, after the UHT turbine medium in conduit 40 has been used to receive all waste heat available from ammonia condenser vessel 2.

The condenser of the AR subsystem refrigerant is shown at 2. Latent heat from the refrigerant in condensor 2 is rejected at the saturation pressure of the refrigerant circulating through it, at the operating pressure of the AR subsystem generator 4. The higher that operating pressure may become, the higher the saturation temperature at which the latent heat rejected to condense the refrigerant will occur.

The ambient condenser 6 is connected in the upper hydrocarbon turbine cycle which proceeds through hydrocarbon turbine units 8 and 10. These two turbine units in the diagram may actually be only a single turbine system with an extraction point located between them, analogous to a conventional multi-stage steam turbine with a reheat cycle between two of its stages.

In the present invention, recuperator 12 is a heat exchanger introduced between a hotter and cooler portion of the hydrocarbon turbine medium cycle points, but it is not located between the turbine exhaust and the ambient turbine condenser 6 as would be the case with previously reported conventional recuperator installations. At this new location, it has become an Elevated Temperature Recuperator (ETRCP).

The hydrocarbon turbine medium at its exhaust pressure at outlet 14 of turbine unit 10 is conducted through conduit 16 to condenser inlet 18 where it is condensed conventionally at a minimum approach temperature above that of the ambient cooling source, such as water, for example, supplied to condenser 6 through conduits 20 and 176 and inlet 22 and the turbine medium condensate leaves condenser 6 through outlet 24 via conduit 26. The condensate return pump 28, having inlet 30 connected to conduit 26 pressurizes the returning feed stream to an elevated pressure in pump outlet conduit 32, still at approximately the temperature at which it was condensed in condenser 6. The hydrocarbon turbine medium is then supplied as a cooling stream to inlet 34 of the refrigerant condenser 2 of the AR subsystem, where it receives at least the latent heat rejected from the refrigerant flowing therethrough from conduit 38 to effect condensation of the liberated refrigerant vapor leaving the rectifier vessel 48 of the AR subsystem. At that point, the temperature of the liquid turbine medium return stream is now at the elevated temperature induced by regenerative absorption of at least the latent heat rejected from the condensing refrigerant vapor. The hydrocarbon turbine medium exiting condenser 2 via conduit 40 may also have acquired some refrigerant vapor superheat before condensation begins, and some amount of heat from sub-cooling of the refrigerant condensate leaving condenser 2 through conduit 42.

At this elevated temperature the hydrocarbon turbine medium in conduit 40 must be capable of absorbing heat rejected from the expanding turbine medium at the point 45 at which turbine medium vapor in conduit 44 is extracted between turbine units 8 and 10 to be cooled by counterflowing turbine medium via conduit 40 at the elevated temperature thereof acquired before leaving condenser 2. To accomplish this, the pressure at which the extraction point 45 between turbine units 8 and 10 must be chosen such that, after the superheat level reached during that part of the turbine medium cycle expansion occurring through turbine unit 8 is rejected to the counterflowing feed stream received from condenser 6 together with any latent heat that might be removed to reduce the ensuing vapor condition to a wet or saturated vapor condition if desired, the heat to be absorbed will not raise the temperature of the flow in conduit 46 exiting recuperator 12 above the minimum approach temperature difference needed to effect the heat transfer intended. Turbine medium from conduit 44 passing through elevated temperature recuperator 12 is conducted by conduit 47 to the inlet of turbine unit 10.

The return feed stream in conduit 46 may now continue its cycle, being heated successively by absorption of the superheat content of the refrigerant vapor leaving unit 48 in conduit 50 and flowing through pump 52 and conduit 54, and finally being heated to turbine entry conditions of turbine unit 8 in heat exchanger unit 56, the hydrocarbon boiler, from where it is conducted by conduit 58 to the inlet at the high temperature end of turbine unit 8.

The remaining portion of the turbine expansion process, occurring in turbine unit 10, takes place by expansion from the saturated or wet vapor condition resulting from rejection of a portion of its heat content in elevated temperature recuperator 12 to its ultimate turbine exhaust condition at the entry 18 to the turbine ambient condenser 6 via conduit 16. As a result of removal of a portion of its heat content at the intermediate point 45 between turbine units 8 and 10, expansion to the exhaust pressure leaving turbine unit 10 causes the turbine vapor to arrive at the turbine exit point 14 ideally at very nearly saturation temperature for the pressure at the turbine exhaust, a pressure approximating the lowest pressure at which the exiting vapor may be condensed by the ambient cooling source (such as water) available at the site of the installation.

Figure 2:
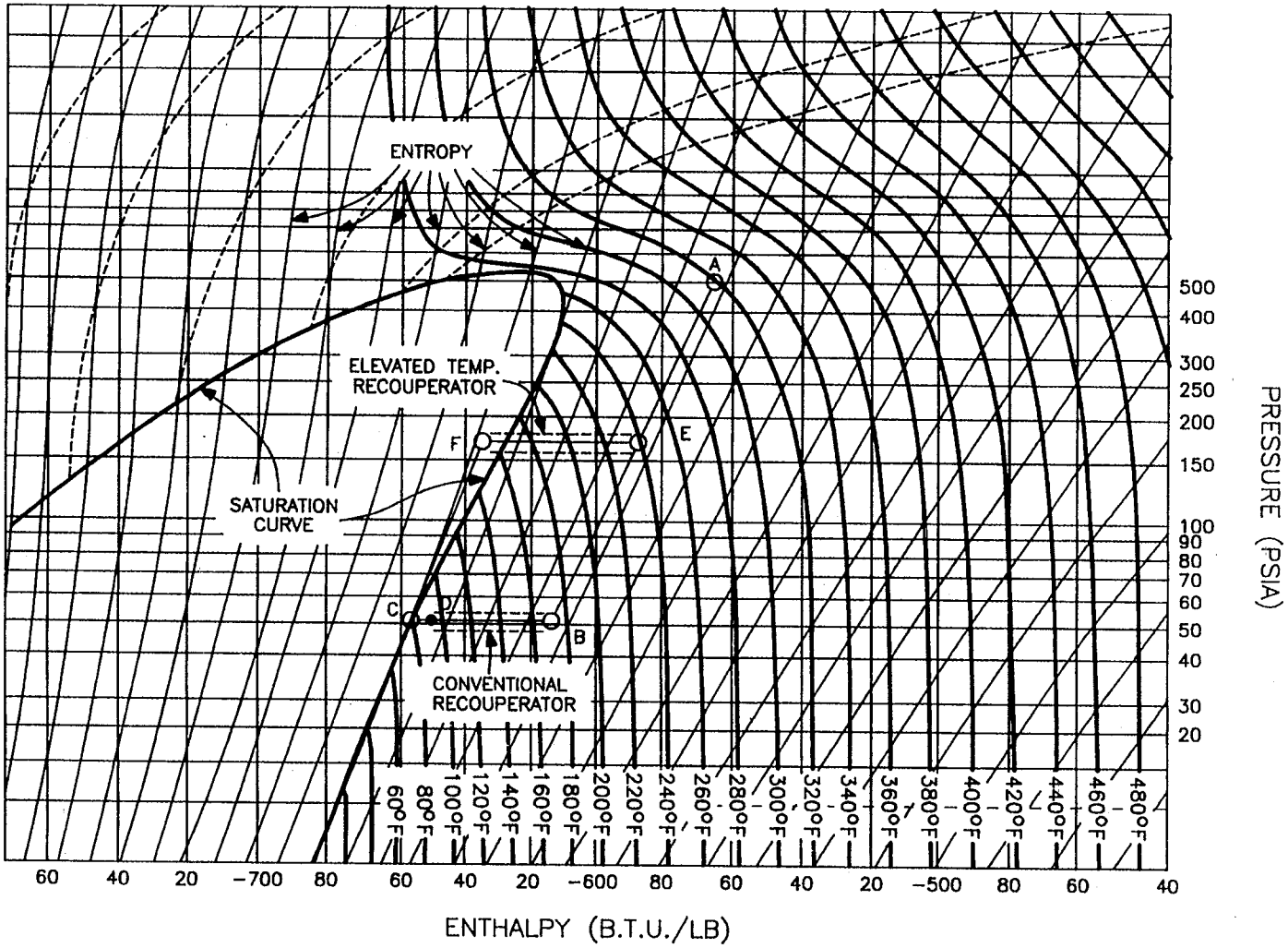
FIG. 2 is a diagram illustrating the thermodynamic state conditions occurring in the turbine cycle embodying the invention shown in FIG. 1 plotted on the dry vapor portion of a Moliere diagram for ISO-butane (e.g. in "Fluid Thermodynamic Properties of Light Petroleum Systems", by Kenneth Starling, Gulf Publishing Co., Houston, Tex., 1973).

The benefit of the invention may best be illustrated by a numerical example. The diagram presented in FIG. 2 illustrates the thermodynamic state conditions occurring in a turbine cycle embodying the elevated temperature recuperator concept plotted on the dry vapor portion of a Moliere diagram for iso-butane. Assumed external conditions provide for an external heat source capable of delivering iso-butane vapor leaving the boiler 6 (in FIG. 1) at a temperature of 320° F., and the external coolant supply is assumed capable of delivering liquid phase condensate from the condenser 140 (in FIG. 1) at a temperature of 80° F. For convenience of illustration, a peak pressure in the cycle, leaving boiler 6, of 500 psia has been chosen.

For these conditions, the thermodynamic state conditions of the vapor leaving the boiler 6 to enter the turbine cycle through conduit 58 are the same at point A in FIG. 2 for each example being compared:

t=320° F.; P=500 psia; H (relative enthalpy)=−566.5 btu/lb; s (relative entropy)=1.237 btu/lb/° R For a simple ORC turbine cycle expanding to its saturation pressure at its condensing temperature, the turbine exit conditions at 14 in FIG. 1, point B in FIG. 2, for a theoretical isentropic expansion would become:

t=176.7° F.; P=53.0 psia; H=−611.8 btu/lb; s=1.237 btu/lb/°R

Having arrived at the saturation pressure at point 18 in FIG. 1, for condensation at 80° F., all the superheat heat content remaining in the turbine exhaust from its 176.7° F. turbine exit condition temperature to the saturation temperature at 53 psia becomes waste heat to be removed by condenser cooling water to arrive at saturation condition at point C. That cycle is illustrated as the solid line on the diagram in FIG. 2.

To overcome most of that superheat waste loss, a conventional recuperator has been introduced between the turbine exhaust at 14 in FIG. 1, point B in FIG. 2, and the condenser entry 18 in FIG. 1, at point C in FIG. 2. Liquid phase turbine medium condensate leaving the condenser 6 at a temperature of 80° F. is pumped back through the recuperator (a heat exchanger) in counterflow heat exchange relationship to the entering superheated vapor at turbine exit condition point B. To assure a minimum approach difference remaining at the cool end of the recuperator (assume a 10° F. minimum approach difference), the exit temperature of the vapor from the recuperator will not be less than 90° F. In cooling the vapor to that temperature, the amount of superheat left to be wasted in the condenser is that remaining in that last ten degrees (approximately 4 btu). The rest has become regenerative feed stream heating, thereby reducing the amount of external heat input that must be supplied in boiler 56 (which receives it from the external high temperature heat source). State conditions at the recuperator vapor exit, point D, after cooling along the dashed line path, become:

t=90° F.; P=53.0 psia; h=−656.6 btu/lb

Location of a conventional recuperator is shown between point B and point D, ten degrees hotter than point C in the simple cycle solid line path on the diagram in FIG. 2. Thermodynamic state conditions for the turbine exhaust location at point B remain unchanged.

By contrast, returning liquid phase turbine medium in the low temperature engine system of the invention shown in FIG. 1 has first been used for another regenerative internal heat recovery operation by circulation through elevated temperature waste heat rejection point in 2 (the ammonia condenser) in its associated absorption refrigeration sub-system. It leaves that subsystem at an already elevated temperature before arriving at the entry to the elevated temperature recuperator 12. For this example, it has been assumed to have acquired a temperature of at least 150° F. during that process before arriving at 12 (point F in FIG. 2).

Allowing the same minimum 10° F. approach difference criterion requirement at the cool end of the elevated temperature recuperator 12 now located between points E and F in FIG. 2, counterflowing turbine medium vapor must leave the elevated temperature recuperator at a temperature not less than 160° F. To minimize ultimate waste heat loss at final turbine exit 14, the elevated temperature recuperator 12 has been selected to permit cooling the turbine medium vapor to a condition at that temperature that is isentropic with respect to final turbine exhaust pressure at saturation condition at 80° F.

To accomplish such a process, the upper portion 8 of the turbine has been equipped with an intermediate extraction point 45 permitting the vapor medium to be withdrawn from the turbine at point E in the diagram in the following state conditions:

t=237.9° F.; P=162 psia; h=−588.9 btu/lb; s=1.237 btu/lb/°R isentropic with reference to original turbine entry conditions. In passing through the elevated temperature recuperator 12 it must exit in a condition as close to isentropic with respect to saturation pressure for the final turbine exit conditions. To accomplish that, it is cooled in the elevated temperature recuperator, traversing the path indicated by the line with x marks in FIG. 2, to the following state conditions at point F in the diagram. The exit condition from the elevated temperature recuperator heat exchanger in conduit 47 in FIG. 1 (and entry condition at its point of return to the remainder of the turbine cycle (turbine section 10 in FIG. 1) below the intermediate extraction point F) becomes:

t=160.7° F.; P=162 psia; h=−637.2 btu/lb; s=1.162 btu/lb/°R

In order to achieve an isentropic relationship to state conditions at the intended turbine exhaust conditions at 14 in FIG. 1 at saturation temperature and pressure for 80° F. condensation, at the −637.2 btu/lb enthalpy condition cited at point F, the vapor is actually in a wet vapor condition with a quality of 93.7% but well within tolerable moisture content consideration in the current state of the art of turbine system design. After re-entering the turbine in these state conditions, final expansion of the medium through the remainder of the turbine 10, along the E marked path in FIG. 2, results in isentropic turbine exit state conditions at point 14 in FIG. 1, point C in FIG. 2, and condenser 6 entry, of:

t=80° F.; P=53.0 psia; h=−655.4 btu/lb; s=1.162 btu/lb/°R

There is no longer a requirement to maintain a 10° F. approach loss as was true for the conventional recuperator between points B and D. The exhaust pressure may simply be the saturation pressure at 80° F., or even some other wet vapor condition (to the left of point C in FIG. 2), but still above minimum tolerable moisture content quality.

In all three examples, the state conditions of the medium leaving the condenser 6 in its liquid phase become:

t=80° F.; P=53.0 psia; h=−797.1 btu/lb; s=0.899 btu/lb/°F.

In all cases, the required input heat energy to return the cycle to the conditions required at the boiler exit (turbine 8 entry) point A in FIG. 2 becomes the change in enthalpy required between liquid phase condenser exit state condition and vapor phase boiler exit condition (−797.1 +566.5)=230.6 btu/lb.

In the simple conventional ORC turbine cycle, that entire amount of input heat energy must be supplied from the external heat source (via 106 in FIG. 1) being input to the boiler. In the conventional recuperator system, (−611.8 +656.6)=44.8 btu of regenerative heat recovery is accomplished, leaving the remaining input heat required, to be supplied by the external heat source to the boiler, reduced to (230.6−44.8)=185.8 btu external heat input to arrive back at point A to repeat its cycle.

In the elevated temperature recuperator cycle of the invention, (−637.2 +588.9) or 48.3 btu of internal regenerative heat recovery was accomplished and no residual superheat remained as waste to be rejected in the condenser. The net input heat to be supplied in the boiler becomes (230.6−48.3)=182.3 btu external heat input to complete its cycle to point A.

Assuming 85% turbine efficiency in all cases, net output work for the simple ORC cycle becomes 0.85(−611.8 +566.5)=38.5 btu/lb. For the conventional recuperator cycle, it remains unchanged but requires less external input heat energy. Net output work for the elevated temperature recuperator cycle of the invention becomes the sum of the outputs of the two sections 8 and 10 of its turbine (above and below the intermediate extraction point 45):

$$0.85[(-588.9+566.5]+[-655.4+637.2])=34.5 \text{ btu/lb}$$

Comparative thermodynamic efficiency of conversion of net external heat supplied to the systems to output work delivered become:

Simple ORC turbine: $(38.5/230.6)\times 100=16.7\%$

Conventional recuperator cycle: $(38.5/185.8)\times 100=20.8\%$

Elevated temperature recuperator cycle:

$$(34.5/182.3)\times 100=18.9\%$$

Advantage of introducing either recuperator in the system, when the turbine employs one of the thermodynamic media possessing the characteristic saturation curves of those described herein, is apparent from the tabulation of comparative efficiencies listed.

In the case of applications as an improvement for the low temperature engine system equipment complement, elevated temperature operating parameters are necessary if recuperation is to be employed with the counterflowing liquid phase turbine medium having been previously heated by other low temperature engine system components illustrated in FIG. 1 (viz. refrigerant condenser 2).

However, even for use with a simple ORC turbine cycle (i.e.—one not associated with the low-temperature engine system described in FIG. 1), it can be seen that use of a heat exchanger dependent for its performance on minimum approach differences at the cold end of the heat exchanger, the conventional ORC turbine cycle recuperator location requires the maximum size heat exchanger, built of most advantageous materials for accomplishing the heat transfer required, with the greatest demand for careful operational control and maintenance during the life of the plant, to assure its reliability in performance.

By contrast, without having been preheated by associated auxiliary equipment as is the case in the low temperature engine system application, exiting condensate from the condenser, at the 80° F. temperature leaving the condenser of a simple ORC turbine system, would have the advantage of a (160.7−80)=80.7° F. approach difference across its cool end entering an elevated temperature recuperator, if located between points E and F along its cycle path. That permits the recuperator heat exchanger to be physically much smaller, to be built of less expensive materials, and to remain reliably able to perform its intended function despite less rigorous maintenance to keep it in peak condition. There would also be a small reduction in condenser cooling water requirements.

Location of a conventional recuperator fixes its thermal regimen by the temperature at which the condenser operates, a temperature related to the best available ambient cooling at the site and something not within control of the designer. The thermal regimen across which the elevated temperature recuperator operates is entirely within ability of the designer to optimize since selection of the extraction point in the turbine cycle determines its operating parameters.

Numerical state conditions presented for illustration of a comparison of the various cycles are essentially "ideal" theoretical values. No effort to adjust them to provide for less than ideal conditions that exist in real equipment such as: non-isentropic conditions that occur during expansion due to turbine efficiency losses; pressures cited do not incorporate allowances for pressure drops through piping, fittings, and valves; and no allowance for temperature drops due to non-adiabatic heat losses that occur in passing through piping and other equipment has been made.

I claim:

1. In an engine system including means for supplying heat energy input, an absorption-refrigeration subsystem having a circulating refrigerant for receiving and for synthesizing and imparting to said system a continuous-flow low temperature heat sink including a refrigerant evaporator and condenser at a selected temperature, a heat engine, a circulating thermodynamic medium in heat exchange relationship with said heat engine and said heat energy input means and in heat exchange relationship at said refrigerant condenser with said refrigerant, said thermodynamic medium having a vaporization temperature lower than that of steam at the same pressure and a melting point temperature lower than that of water, said heat engine operating across a thermal gradient and having a high temperature end communicating with said thermodynamic medium from a heat exchange relationship of said thermodynamic medium with said heat energy input means and a low temperature end through which said thermodynamic medium flows before heat exchange relationship thereof with said refrigerant in said refrigerant condenser, and an external cooling source for providing a cooling fluid in heat exchange relationship with said refrigerant external to a refrigerant absorber, the improvement comprising:

an elevated temperature recuperator in the form of a heat exchanger;

an extraction point between said high and low temperature ends of said engine located upstream of ambient exhaust pressure at said low temperature end for extraction of thermodynamic medium vapor flowing therethrough;

a thermodynamic medium condenser having a first inlet communicating with said low temperature end of said heat engine and a first outlet for condensed thermodynamic medium;

a first inlet to said refrigerant condenser communicating with said first outlet of said thermodynamic medium condenser;

a first outlet for said refrigerant condenser for flowing therethrough said liquid thermodynamic medium heated in said refrigerant condenser to a minimum temperature of approximately 30° F. above the temperature of the condensate from said first outlet of said thermodynamic medium condenser;

a first inlet to said recuperator communicating with said extraction point for receiving said extracted thermodynamic medium vapor therefrom;

a second inlet to said recuperator connected to said first outlet of said refrigerant condenser;

a second outlet for said recuperator;

said thermodynamic medium vapor from said extraction point flowing through said recuperator in counterflowing heat exchange relationship with said heated liquid thermodynamic medium from said first outlet of said refrigerant condenser for effecting the removal of a portion of the heat content of said extracted vapor from said extraction point and raising the temperature of said counterflowing liquid thermodynamic medium;

a first outlet for said recuperator communicating with an intermediate inlet to said heat engine between said high and low temperature ends thereof and downstream of said extraction point; and conduit means connecting said second outlet of said recuperator via additional sources of heat energy input to said high temperature end of said heat engine;

said thermodynamic medium comprising a material having a saturation curve diverging from the isentropic curve thereof as the temperature and pressure decrease.

2. The improvement in a low temperature engine system as claimed in claim 1, and further comprising:

a second inlet to said thermodynamic medium condenser communicating with said external cooling source;

said thermodynamic medium condenser comprising means for conducting therethrough said cooling fluid from said external cooling source in heat exchange relationship with said thermodynamic medium therein;

a second outlet for said thermodynamic medium condenser for said cooling fluid communicating with a return conduit to said external cooling source;

a second inlet to said refrigerant condenser communicating with said refrigerant from said absorption refrigeration subsystem;

said refrigerant condenser comprising means for conducting said refrigerant therethrough in heat exchange relationship with said thermodynamic medium flowing therethrough from said first inlet to said first outlet thereof; and a second outlet for said refrigerant condenser communicating with a return conduit for said refrigerant to said subsystem;

so that said refrigerant condenser fucntions as an internal source of regenerative heat recovery for heating said thermodynamic medium to not less than said 30° F. temperature increase above said condensate temperature in said thermodynamic medium condenser.

3. The improvement in a low temperature engine system as claimed in claim 1 wherein:

said elevated temperature recuperator comprises a heat exchanger operating across a temperature gradient so that liquid thermodynamic medium exiting said recuperator through said second outlet thereof is at least 5° F. below said extracted vapor entering said recuperator through said first inlet thereof, and said vapor leaving said recuperator through said first outlet thereof is cooled to a temperature at least 5° F. above the temperature of liquid thermodynamic medium entering said recuperator through said second inlet thereto.

4. The improvement in a low temperature engine system as claimed in claim 2 wherein:

said elevated temperature recuperator comprises a heat exchanger operating across a temperature gradient so that liquid thermodynamic medium exiting said recuperator through said second outlet thereof is at least 5° F. below said extracted vapor entering said recuperator through said first inlet thereof, and said vapor leaving said recuperator through said first outlet thereof is cooled to a temperature at least 5° F. above the temperature of liquid thermodynamic medium entering said recuperator through said second inlet thereto.

5. The improvement in a low temperature engine system as claimed in claim 1 wherein:

said thermodymamic medium vapor leaving said elevated temperature recuperator through said first outlet thereof comprises a saturated vapor.

6. The improvement in a low temperature engine system as claimed in claim 2 wherein:

said thermodymamic medium vapor leaving said elevated temperature recuperator through said first outlet thereof comprises a saturated vapor.

7. The improvement in a low temperature engine system as claimed in claim 3 wherein:

said thermodymamic medium vapor leaving said elevated temperature recuperator through said first outlet thereof comprises a saturated vapor.

8. The improvement in a low temperature engine system as claimed in claim 4 wherein:

said thermodymamic medium vapor leaving said elevated temperature recuperator through said first outlet thereof comprises a saturated vapor.

9. The improvement in a low temperature engine system as claimed in claim 1 wherein:

said thermodymamic medium vapor leaving said elevated temperature recuperator through said first outlet thereof has a wet vapor condition.

10. The improvement in a low temperature engine system as claimed in claim 2 wherein:

said thermodymamic medium vapor leaving said elevated temperature recuperator through said first outlet thereof has a wet vapor condition.

11. The improvement in a low temperature engine system as claimed in claim 3 wherein:

said thermodymamic medium vapor leaving said elevated temperature recuperator through said first outlet thereof has a wet vapor condition.

12. The improvement in a low temperature engine system as claimed in claim 4 wherein:

said thermodymamic medium vapor leaving said elevated temperature recuperator through said first outlet thereof has a wet vapor condition.

13. The improvement in a low temperature engine system as claimed in claim 1 and further comprising:

further heat exchanging means between said second outlet of said recuperator and said high temperature end of said heat engine through which said thermodynamic medium in liquid form passes;

said refrigerant passing through said further heat exchanging means in heat exchange relationship with said liquid thermodynamic medium therein, so that the minimum temperature in said further heat exchanging means is approximately 5° F. higher than said liquid thermodynamic medium leaving said recuperator through said second outlet thereof.

14. The improvement in a low temperature engine system as claimed in claim 2 further comprising:

further heat exchanging means between said second outlet of said recuperator and said high temperature end of said heat engine through which said thermodynamic medium in liquid form passes;

said refrigerant passing through said further heat exchanging means in heat exchange relationship with said liquid thermodynamic medium therein, so that the minimum temperature in said further heat exchanging means is approximately 5° F. higher than said liquid thermodynamic medium leaving said recuperator through said second outlet thereof.

15. The improvement in a low temperature engine system as claimed in claim 3 further comprising:

further heat exchanging means between said second outlet of said recuperator and said high temperature end of said heat engine through which said thermodynamic medium in liquid form passes;

said refrigerant passing through said further heat exchanging means in heat exchange relationship with said liquid thermodynamic medium therein, so that the minimum temperature in said further heat exchanging means is approximately 5° F. higher than said liquid thermodynamic medium leaving said recuperator through said second outlet thereof.

16. The improvement in a low temperature engine system as claimed in claim 4 further comprising:

further heat exchanging means between said second outlet of said recuperator and said high temperature end of said heat engine through which said thermodynamic medium in liquid form passes;

said refrigerant passing through said further heat exchanging means in heat exchange relationship with said liquid thermodynamic medium therein, so that the minimum temperature in said further heat exchanging means is approximately 5° F. higher than said liquid thermodynamic medium leaving said recuperator through said second outlet thereof.

17. The improvement in a low temperature engine system as claimed in claim 5 further comprising:

further heat exchanging means between said second outlet of said recuperator and said high temperature end of said heat engine through which said thermodynamic medium in liquid form passes;

said refrigerant passing through said further heat exchanging means in heat exchange relationship with said liquid thermodynamic medium therein, so that the minimum temperature in said further heat exchanging means is approximately 5° F. higher than said liquid thermodynamic medium leaving said recuperator through said second outlet thereof.

18. The improvement in a low temperature engine system as claimed in claim 6 further comprising:

further heat exchanging means between said second outlet of said recuperator and said high temperature end of said heat engine through which said thermodynamic medium in liquid form passes;

said refrigerant passing through said further heat exchanging means in heat exchange relationship with said liquid thermodynamic medium therein, so that the minimum temperature in said further heat exchanging means is approximately 5° F. higher than said liquid thermodynamic medium leaving said recuperator through said second outlet thereof.

19. The improvement in a low temperature engine system as claimed in claim 7 further comprising:

further heat exchanging means between said second outlet of said recuperator and said high temperature end of said heat engine through which said thermodynamic medium in liquid form passes;

said refrigerant passing through said further heat exchanging means in heat exchange relationship with said liquid thermodynamic medium therein, so that the minimum temperature in said further heat exchanging means is approximately 5° F. higher than said liquid thermodynamic medium leaving said recuperator through said second outlet thereof.

20. The improvement in a low temperature engine system as claimed in claim 11 further comprising:

a further heat exchanging means between said second outlet of said recuperator and said high temperature end of said heat engine through which said thermodynamic medium in liquid form passes;

said refrigerant passing through said further heat exchanging means in heat exchange relationship with said liquid thermodynamic medium therein, so that the minimum temperature in said further heat exchanging means is approximately 5° F. higher than said liquid thermodynamic medium leaving said recuperator through said second outlet thereof.

21. The improvement in a low temperature engine system as claimed in claim 13 and further comprising:

a thermodynamic medium outlet in said further heat exchanging means;

a hydrocarbon boiler having a first inlet communicating with said thermodynamic medium outlet of said further heat exchanging means, and a first outlet communicating with said high temperature end of said heat engine, a second inlet communicating with said heat energy input means, and a second outlet for said heat energy input means, so that said thermodynamic medium flows through said hydrocarbon boiler in heat exchange relationship with said heat energy input means for heating said thermodynamic medium to a desired heat engine inlet temperature by heat energy from said heat energy input means.

22. An organic Rankine cycle engine system employing a thermodynamic medium circulating therethrough, said thermodynamic medium having a saturation curve portion adjacent to the dry vapor region being traversed by the engine cycle which exhibits a declining value of unit entropy as its saturation pressure and temperature concurrently reduce that is faster than decline of temperature and pressure across the same range in the superheated vapor area under isentropic expansion conditions, comprising:

a turbine engine through which said thermodynamic medium flows having a high temperature inlet, a low temperature outlet, and an intermediate extraction point between said high temperature inlet and low temperature outlet;

an external heat energy source;

a boiler through which said external heat energy source flows and through which said thermodynamic medium flows in heat exchange relationship with said external heat energy source for raising the temperature and vaporizing said thermodynamic medium to the desired thermodynamic state conditions at said high temperature inlet to said turbine engine;

conduit means connecting a first outlet in said boiler to said high temperature inlet for conducting said vaporized high temperature thermodynamic medium to said turbine engine;

an elevated temperature recuperator heat exchanger having a first inlet communicating with said intermediate extraction point for the flow of thermodynamic medium to said recuperator heat exchanger, and a first outlet;

a second inlet and a second outlet in said recuperator heat exchanger for the flow of liquid phase thermodynamic medium therethrough in counterflowing heat exchange relationship with said vaporized thermodynamic medium;

a second turbine engine inlet between said intermediate extraction point and said low temperature outlet, and communicating with said first recuperator heat exchanger outlet for the flow of cooled vapor from said recuperator heat exchanger to said second turbine engine inlet for continued expansion of said thermodynamic medium through said turbine engine to said low temperature outlet;

an external cooling supply source;

a thermodynamic medium condenser heat exchanger comprising a first inlet communicating by a conduit means with said low temperature turbine engine outlet, a first outlet, a second inlet communicating by a conduit means with said external coolant supply source, and a second outlet for said external coolant, so that said thermodynamic medium and external coolant flow in counterflowing heat exchange relationship with each other and said thermodynamic medium rejects sufficient heat to said external coolant to cause said thermodynamic medium to undergo complete phase change from vapor to liquid form;

a condenser pump comprising a pump inlet connected by conduit means to said first outlet of said thermodynamic medium condenser heat exchanger for conducting liquid phase thermodynamic medium from said thermodynamic medium condenser heat exchanger to said condenser pump, and a condenser pump outlet, said condenser pump being operable to raise the pressure of said liquid phase thermodynamic medium to a required pressure for maintaining the pressure above saturation pressure as the temperature of said liquid phase thermodynamic medium rises during ensuing heat exchange processes;

conduit means connecting said condenser pump outlet to said second inlet of said elevated temperature recuperator for conducting circulating liquid phase thermodynamic medium from said condenser pump for flowing through said recuperator in heat exchange relationship with counterflowing vaporized thermodynamic medium and through said second recuperator outlet, so that the temperature of said liquid phase thermodynamic medium at said second outlet of said recuperator is not less than 5° F. lower than the temperature of the counterflowing vaporized thermodynamic medium entering said recuperator at said first inlet of said recuperator;

boiler feed pump means having an inlet connected to said second outlet of said recuperator and an outlet communicating with said first inlet of said boiler for raising the pressure of liquid phase thermodynamic medium entering said boiler feed pump means sufficiently high to pass from said outlet of said boiler feed pump means to said first inlet of said boiler to produce sufficient pressure at said first inlet to said boiler so that said boiler delivers thermodynamic medium vapor therefrom through said first outlet of said boiler to said first turbine engine high temperature inlet at a predetermined pressure; and valve means and control means in said system for permitting safe operation of said system.

23. The organic Rankine cycle engine system as claimed in claim 22 wherein:

said thermodynamic medium comprises a material selected from the group consisting of hydrocarbon fluids possessing characteristics of said saturation curve portion.

24. The organic Rankine cycle engine system as claimed in claim 23 wherein:

said thermodynamic medium comprises a material selected from the group consisting of hydrocarbon fluids possessing characteristics of said saturation curve portion.

25. The organic Rankine cycle engine system as claimed in claim 22 wherein:

said thermodynamic medium comprises a material selected from the group consisting of n-butune, iso-butane, n-pentane, iso-pentane, and hydrocarbon blends containing at least one of said hydrocarbons as principal constituents.

26. The organic Rankine cycle engine system as claimed in claim 23 wherein:

said thermodynamic medium comprises a material selected from the group consisting of n-butune, iso-butane, n-pentane, iso-pentane, and hydrocarbon blends containing at least one of said hydrocarbons as principal constituents.

* * * * *